US009097028B2

(12) United States Patent
Shpringer et al.

(10) Patent No.: US 9,097,028 B2
(45) Date of Patent: Aug. 4, 2015

(54) POOL COVER AUTOMATIC LOCKING AND UNLOCKING SYSTEM AND METHOD

(75) Inventors: Jacob Shpringer, Beit Hananya (IL); Oliver Chareyron, La Ciotat Cedex (FR); Amir Armoza, Kibbutz Yizraeel (IL)

(73) Assignee: MAYTRONICS LTD., Kibutz Yizrael (IL)

( * ) Notice: Subject to any disclaimer, the term of this patent is extended or adjusted under 35 U.S.C. 154(b) by 532 days.

(21) Appl. No.: 13/540,638

(22) Filed: Jul. 3, 2012

(65) Prior Publication Data

US 2014/0007338 A1 Jan. 9, 2014

(51) Int. Cl.
*E04H 4/00* (2006.01)
*E04H 4/08* (2006.01)

(52) U.S. Cl.
CPC . *E04H 4/08* (2013.01); *E04H 4/082* (2013.01)

(58) Field of Classification Search
CPC ..... E04H 4/1263; E04H 4/1272
USPC ..... 70/280; 4/498, 508
See application file for complete search history.

(56) References Cited

U.S. PATENT DOCUMENTS

| | | | | |
|---|---|---|---|---|
| 3,613,126 | A * | 10/1971 | Granderath | 4/502 |
| 5,282,282 | A | 2/1994 | Shehan et al. | |
| 5,608,926 | A * | 3/1997 | Donaton | 4/503 |
| 2010/0230336 | A1 * | 9/2010 | Davies et al. | 210/167.2 |
| 2012/0167646 | A1 * | 7/2012 | Sharma et al. | 70/280 |

FOREIGN PATENT DOCUMENTS

| | | | |
|---|---|---|---|
| FR | 2936829 | | 4/2010 |
| FR | 2936829 | A1 * | 4/2010 |

* cited by examiner

*Primary Examiner* — Janie Christiansen
(74) *Attorney, Agent, or Firm* — Reches Patents

(57) ABSTRACT

An automatic system for locking and unlocking a pool cover having a leading edge at an edge of a pool, the pool having a water surface, the pool cover deployable by a pool cover deployment system, the automatic system comprising: at least one leading edge slot piece having a rectangular slot therein, the leading edge slot piece integratable into the leading edge; at least one float locker subassembly configurable floatably on the water surface and constrained at the edge of the pool, the float locker subassembly having a space defined therein in which the at least one leading edge slot piece is adapted to be received, locked, and unlocked; and an autolock control unit adapted to communicate with the at least one float locker subassembly and the pool cover deployment system, wherein the control unit is further adapted to command and verify locking and unlocking.

14 Claims, 9 Drawing Sheets

(a)

(b)

DETAIL

Detail A

POOL COVER AUTOMATIC LOCKING AND UNLOCKING SYSTEM AND METHOD

FIELD AND BACKGROUND OF THE INVENTION

Embodiments of the current invention are related to swimming and other pool maintenance and safety, using pool covers. More specifically, embodiments of the current invention relate to a pool cover automatic locking and unlocking system and method.

Among benefits of covering pools, the aspect of safety—by preventing drowning and keeping family and friends safe—is foremost. A pool cover additionally acts to prevent access by pets and uninvited visitors from entering a filled or substantially-filled pool. Additionally, a pool cover keeps dirt, leaves, and debris out of the pool when it is not in use. Another significant advantage in covering a pool is savings on operating costs, such as heating; chemicals; cleaning; water evaporation; and extended pool equipment life.

Among the manufacturers of pool covers in the world are:

Zodiac Pool Systems, Inc. 620 Commerce Way Vista, Calif. 92081, USA (and its subsidiary: Cover-Pools Incorporated, 66 East 3335 South Salt Lake City, Utah 84115)

Aquamatic Cover Systems (AMCS, Inc), Gilroy, Calif., USA

Coverstar Central, 7169 East 87th Street, Indianapolis, Ind. 46256 USA

Grando GmbH, De Gasperi-Straβe 6, D-51469 Bergisch Gladbach, Germany

DEL SAS, Z.A. La Croix Rouge, 35530 Brécé, France

Most manufacturers produce pool covers employing flexible sheets of vinyl/Dacron material and/or cloth-like pool covers; whereas some offer semi-rigid covers constructed of interlocking profile pieces, as known in the art. Reference is currently made to FIGS. 1 and 2, which are pictorial schematic views of a pool having a prior art pool cover 5. In FIG. 1, pool cover 5 is shown deployed: partially (a); and nearly completely (b). Pool cover 5 is typically stowed (i.e. retracted) and deployed in a manual; motorized; and/or semi-automatic fashion, as known in the art. Although not emphasized in the figures, the pool is filled with water.

Pool cover 5 has a leading edge 6, as seen in the detail view of FIG. 2. Leading edge 6 typically has the shape of a rigid profile piece (i.e. "slat") as known in the art. Pool cover 5 and leading edge 6 are typically supported after deployment in a floating configuration on/near a pool water surface 9—as shown schematically in the referenced figures. Whereas the pool cover shown in FIGS. 1 and 2 is semi-rigid and is formed of individual interlocking slats, the discussion which follows hereinbelow—specifically related to securing the pool cover once deployed—is applicable to other cover materials and configurations.

In the specification and claims, which follow hereinbelow, the terms "secure", "lock", "fasten", and "attach" are used interchangeably with regard to maintaining a pool cover, once deployed and substantially covering a pool, in a configuration where the cover cannot be readily retracted (i.e. uncovering the pool). Following complete deployment (not shown in the figures) pool cover 5 is typically secured at a pool edge 8, where usually leading edge 6 is attached to the pool edge to enable the cover to fulfill a primary objective of safety, inter alia. Traditionally, straps or other fastening mechanisms (not shown in the figure) are used to manually secure leading edge 6 of deployed pool cover 5 to pool edge 8.

In many locales and countries, there are standards which define how the pool cover is secured. An exemplary standard for pool coverings and securing/locking provisions is French Standard NFP 90 308, whose disclosure is incorporated herein by reference.

An example of prior art dealing with pool covers and specifically to securing a pool cover, once deployed, is U.S. Pat. No. 5,282,282 to Shehan et al., whose disclosure is incorporated herein by reference. Shehan et al. describe an improved swimming pool construction and cover, which include a swimming pool cover laid on the water of the pool and having a marginal edge provided with one component of the two-component elongated locking member. The second component of the locking member is disposed in the pool coping or deck edge accessible at the pool interior for engagement by the locking member component on the pool cover. The locking component associated with the pool is provided in a retrofit configuration by securing a locking component to a vinyl liner bead lock secured in the vinyl liner bead channel in a pool coping. In a new vinyl-lined pool construction, a coping is provided with a secondary channel with one component of the cover locking member secured therein. In a gunnite pool, a channel is formed in the deck edge and a component of the releasable cover locking member is secured in the channel for securement of the pool cover thereto.

Champion et al., in French Patent no. FR2936829, whose disclosure is incorporated herein by reference, describe a floating cover, locking device for swimming pool basin, having an elastic tongue with free end to close inlet orifice in rest position, and operated to release passage across orifice, where device is in form of monoblock assembly. The device has a hollow shell fixed on a vertical wall of a basin of a swimming pool, where the device is in form of a monoblock assembly. The shell comprises an inlet orifice sized for permitting passage of shafts and a housing delimited by a partition having an opening and receiving the shafts. An elastic tongue has a free end for closing, in rest position, the inlet orifice, and is operated to release the passage across the inlet orifice.

Among various shortcomings of prior art cover systems and fastening/securing mechanisms and locking systems are:

- Need to manually adjust and/or guide straps or other mechanisms under water and/or directly at the surface of the pool to fasten the cover;
- Complicated and/or time consuming procedures to secure the fastening mechanism;
- Need for relatively precise positioning of a locking mechanism located at or near the pool's edge with regard to the pool cover edge and its attachment;
- Difficulty of or lack of retrofitability of pool cover fastening mechanisms to existing pools; and
- High cost of the fastening mechanisms/solutions.

As a result of the shortcomings listed, in many cases, pools covers may not be deployed completely or a cover may not be completely/correctly secured once deployed—a situation that not only defeats the advantages listed hereinabove, but which may be illegal with regard to local/governmental standards, as noted hereinabove.

There is therefore a need for a pool cover locking system that is: reliable; easy to use; preferably automatic; and which may be integrated with an existing or newly installed pool cover system in a cost-effective and a straightforward manner.

SUMMARY OF THE INVENTION

According to the teachings of the present invention there is provided an automatic system for locking and unlocking a pool cover having a leading edge at an edge of a pool, the pool having a water surface, the pool cover deployable by a pool cover deployment system, the automatic system comprising: at least one leading edge slot piece having a rectangular slot therein, the leading edge slot piece integratable into the leading edge; at least one float locker subassembly configurable floatably on the water surface and constrained at the edge of the pool, the float locker subassembly having a space defined therein in which the at least one leading edge slot piece is adapted to be received, locked, and unlocked; and an autolock control unit adapted to communicate with the at least one float locker subassembly and the pool cover deployment system, wherein the control unit is further adapted to command and verify locking and unlocking of the at least one leading edge clip with the at least one float locker subassembly. Preferably, leading edge is displaceable floatingly on the water surface and communication by the autolock control unit with the at least one float locker subassembly and the pool cover deployment system is by at least one means chosen from list including: wireless and wired means. Most preferably, the at least one float locker subassembly further comprises: an autolock unit, maintainable above the water surface and having a locking pin adapted to lock and unlock the leading edge slot piece with the float locker subassembly; and an autolock floater unit mechanically attached beneath the autolock unit and separated by the space, the autolock floater unit adapted to be floatingly maintained with regard to the water surface and to present the space to the leading edge slot piece.

Typically, the autolock unit comprises a pin driver motor adapted to retract the locking pin to an unlocked status; a sensor adapted to sense a locked and unlocked status of the locking pin; command and telemetry electronics adapted to receive commands from the autolock control unit to command the pin drive motor and to provide telemetry to the autolock control unit related to the locking pin status; and a power source adapted to provide on board power for the pin drive motor, the sensor, and the command and telemetry electronics. Most typically, the locking pin is adapted to be biased by a spring to have a locked status when the leading edge slot piece is inserted into the space and the rectangular slot is positionable in the space beneath the locking pin. Preferably, the at least one float locker subassembly is slidingly attachable to a vertical guide piece, the vertical guide piece being oriented substantially perpendicularly to the water surface and extending partially below and above the water surface. Most preferably, the vertical guide piece is adapted to be mechanically attached to an edge mounting bracket, the edge mounting bracket adapted to be mechanically attached to the pool edge. Typically, the vertical guide piece has a plurality of protruding ribs, the plurality of protruding ribs oriented substantially perpendicular to the water surface and having a rib spacing dimension substantially equal to that of the space beneath the locking pin and wherein the float locker subassembly is formable to move slidingly with regard to the protruding ribs. Most typically, the at least one leading edge slot piece is substantially constrained in directions parallel and perpendicular to the water surface when the at least one leading edge slot piece is locked in the at least one float locker subassembly.

According to the teachings of the present invention there is further provided a method of using an automatic system for locking and unlocking a pool cover having a leading edge at an edge of a pool, the pool having a water surface, the pool cover deployable by a pool cover deployment system, the method comprising the steps of: configuring at least one leading edge slot piece having a rectangular slot therein and integrating the leading edge slot piece into the leading edge; constraining at least one float locker subassembly at the edge of the pool and configuring the at least one float locker assembly to float on the water surface, with the float locker subassembly having a space defined therein in which the at least one leading edge slot piece is received, locked, and unlocked; and taking an autolock control unit to communicate with the at least one float locker subassembly and the pool cover deployment system, whereby the control unit further commands and verifies locking and unlocking of the at least one leading edge clip with the at least one float locker subassembly. Preferably, the leading edge is displaced floatingly on the water surface and whereby communication by the autolock control unit with the at least one float locker subassembly and the pool cover deployment system is by at least one means chosen from list including: wireless and wired means. Most preferably, locking a deployed pool cover further comprises the steps of: commanding the pool cover deployment system to advance the leading edge towards the edge of the pool substantially at the water surface; configuring an autolock unit of the at least one float locker subassembly to receive the leading edge and to lock and sense the locking of the leading edge; configuring an autolock control unit receive telemetry from each of the at least one autolock unit indicative of the locking of the leading edge and communicating with the pool cover deployment system to command the pool cover deployment system to stop advancing the leading edge; and determining that each of the at least one autolock unit has locked the leading edge and taking corrective action if at least one autoock unit has not locked the leading edge. Typically, unlocking a locked pool cover further comprises the steps of: commanding the pool cover deployment system to unlock the locked pool cover and commanding an autolock unit of the at least one float locker subassembly to unlock the leading edge and to sense the unlocking of the leading edge; configuring an autolock control system to receive telemetry from each of the at least one autolock unit related to the unlocking of the leading edge; determining that each of the at least one autolock unit has unlocked the leading edge and taking corrective action if at least one autoock unit has not unlocked the leading edge; and communicating with the pool cover deployment system and commanding the pool cover deployment system to start retracting the leading edge once a positive determination is made that each of the at least one autolock unit has unlocked the leading edge.

BRIEF DESCRIPTION OF THE DRAWINGS

The invention is herein described, by way of example only, with reference to the accompanying drawings, wherein.

DETAILED DESCRIPTION OF THE PREFERRED EMBODIMENTS

Embodiments of the current invention are related to swimming and other pool maintenance and safety, using pool covers. More specifically, embodiments of the current invention relate to a pool cover automatic locking and unlocking system and method.

Figure 1:
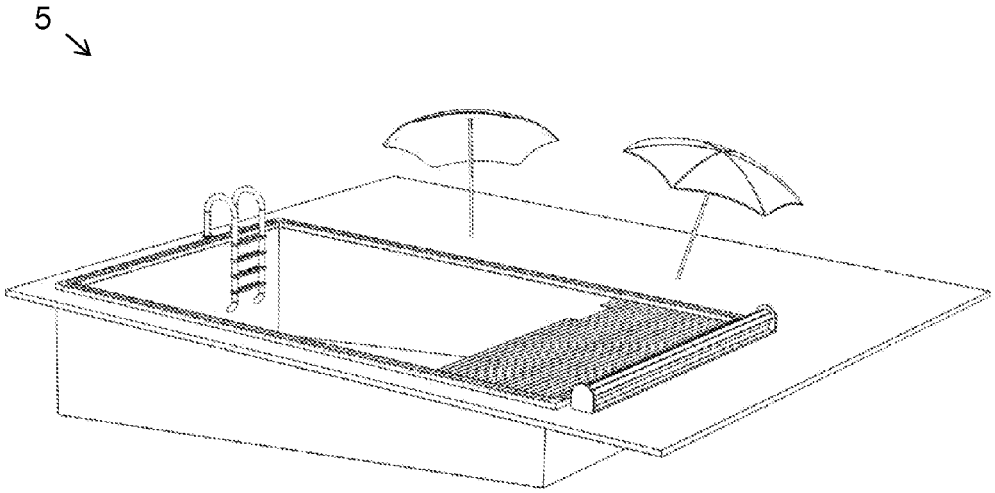
Prior Art FIG 1
FIGS. 1 and 2 are pictorial schematic views of a pool having a prior art pool cover, deployed partially and deployed nearly completely.
Figure 1:
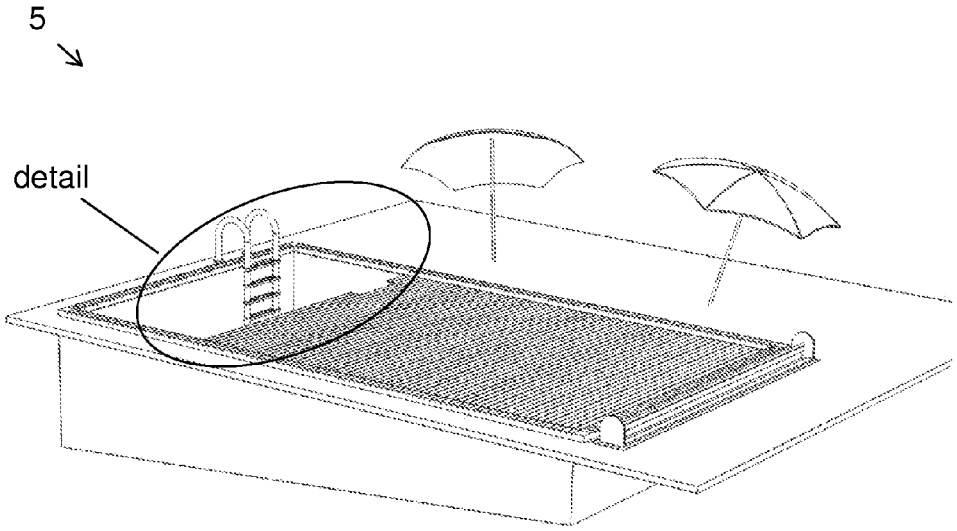
Prior Art FIG 1
Figure 2:
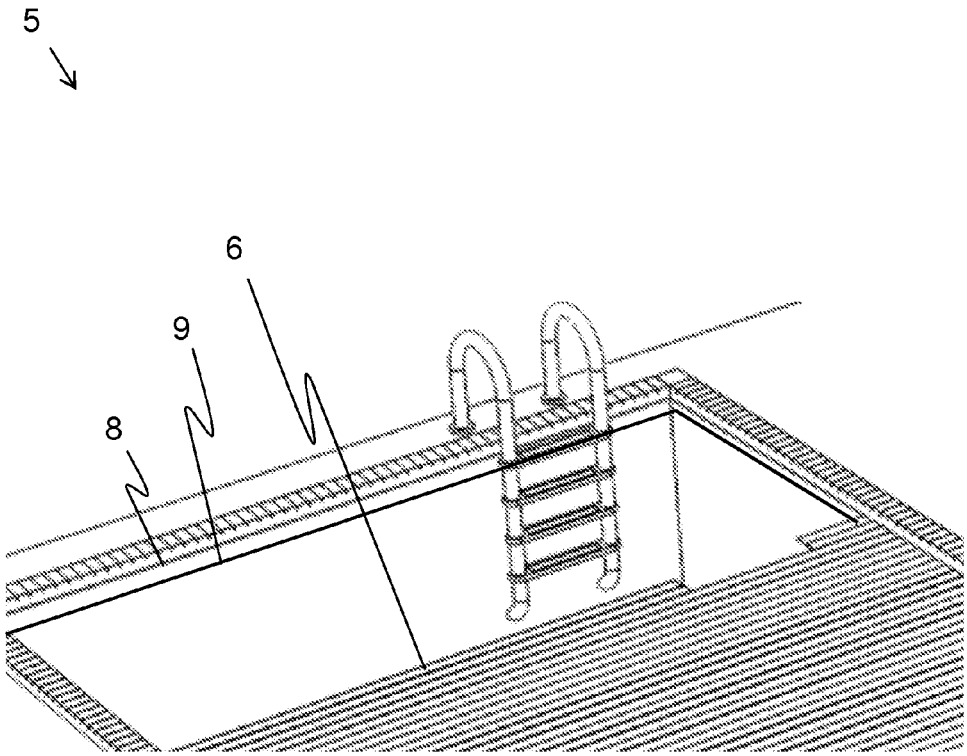
Prior Art FIG 2
Figure 3:
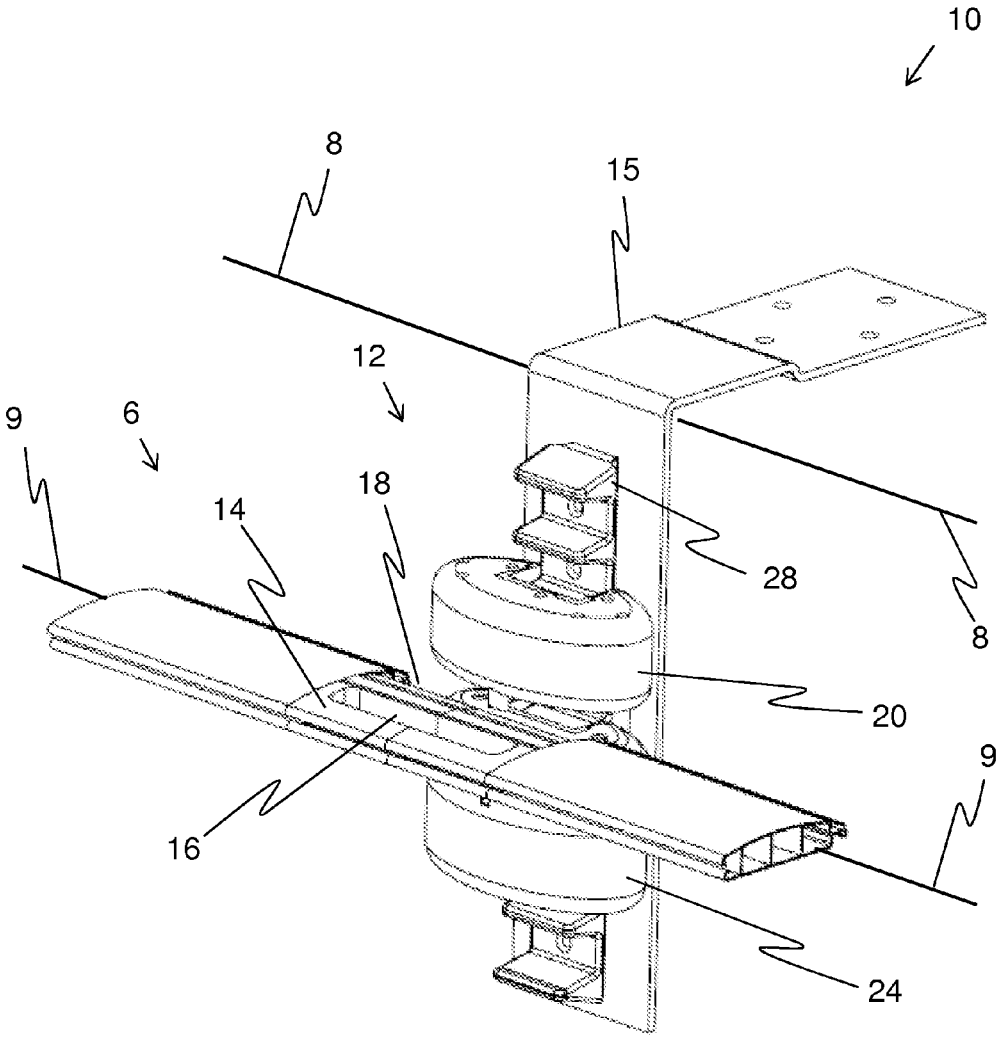
FIG. 3 is an isometric is an isometric view of a float locker subassembly, in accordance with an embodiment of the current invention.

Reference is currently made to FIG. 3, which is an isometric view of a float locker assembly 10, in accordance with an embodiment of the current invention. Float locker assembly 10 includes: a float locker subassembly 12; a leading edge slot piece 14; and a pool edge mounting bracket 15. Apart from differences described below, leading edge 6, pool end 8, and water surface 9 are identical in notation, configuration, and functionality to that shown in previous figures, and elements indicated by the same reference numerals and/or letters are generally identical in configuration, operation, and functionality as described hereinabove. Leading edge slot piece 14 is integrated into leading edge 6 as shown, with the leading edge having a substantially enclosed, rectangular slot 16 formed therein and an opened leading slot 18 facing pool edge mounting bracket 15. Edge mounting bracket 15 has a generally "L" shape and is mechanically connected to the pool end as shown in the figure, with either screws, adhesive, and or both—as known in the art. The general "L" shape of edge mounting bracket 15 may have some bends to allow the edge mounting bracket to be mounted securely to different shapes of pool end 8 (i.e. having a lip or other shape variation, as known in the art). As noted hereinabove, with regard to FIGS. 1-2, the pool is typically filled with water and leading edge, along with most of the pool cover, is supported on the water surface. Part of edge mounting bracket 15 is configured below water surface 9.

Float locker subassembly 12 further includes: an autolock unit 20; an autolock floater unit 24; and a vertical guide piece 28—the latter being oriented substantially vertically (and substantially perpendicularly to the water surface) and partially below the water surface and being mechanically connected to the vertical part of edge mounting bracket 15 as shown in the figure. Autolock unit 20 and autolock floater unit 24 are mechanically connected, as described further hereinbelow, and have a space defined between them (as shown, but not indicated in the figure) to receive leading edge slot piece 14. Autolock unit 20 and autolock floater unit 24 are slidingly connected to vertical guide piece 28, as described further hereinbelow.

Autolock unit 20 and autolock floater unit 24 function together, as further described hereinbelow, to automatically lock the pool cover to the pool edge—once the pool cover is commanded to close—and to automatically unlock a locked pool cover—once a command is given to unlock and open the pool cover. In the specification and claims which follow, the terms "automatic" and "autolock" are intended to mean locking a pool cover into position without the need for manual intervention, once the pool cover has been commanded to close and to unlocking a locked pool cover—once a command is given to unlock and open the pool cover, likewise without the need for manual intervention.

Figure 4:
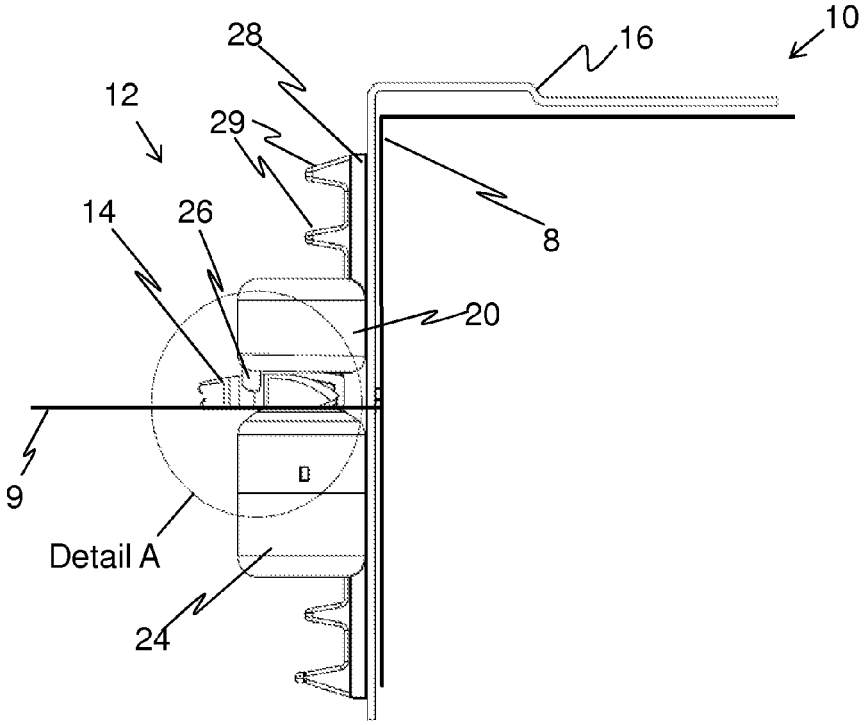
FIGS. 4 and 5 are an orthographic side view and orthographic detail side views, respectively, of the float locker subassembly in FIG. 3.
Figure 5:
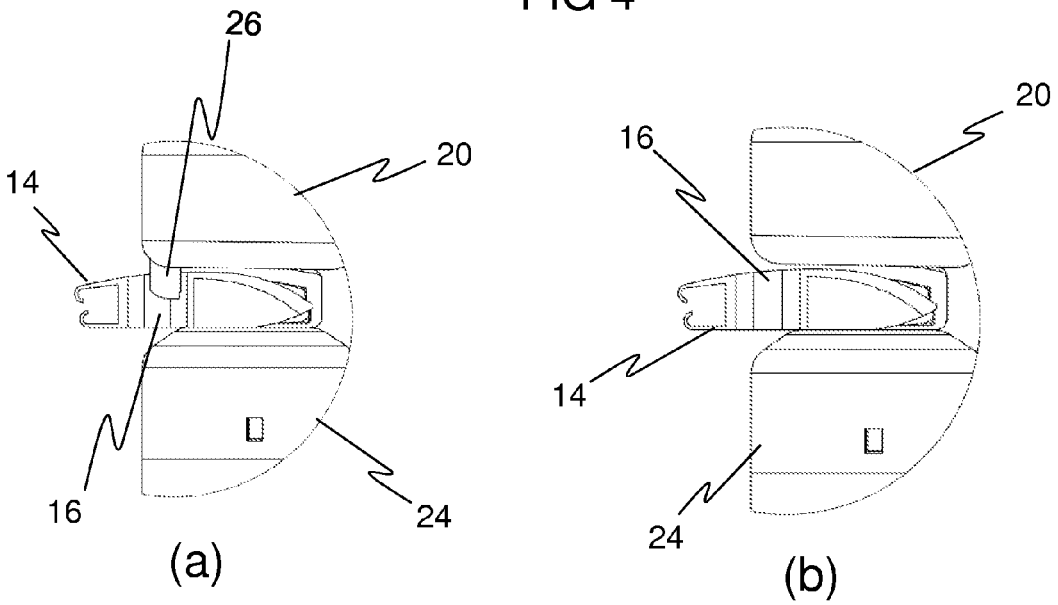

Reference is currently made to FIGS. 4 and 5, which are an orthographic side view and orthographic detail side views, respectively, of the float locker subassembly in FIG. 3. Apart from differences described below, pool end 8, and water surface 9 are identical in notation, configuration, and functionality to that shown in previous figures, and elements indicated by the same reference numerals and/or letters are generally identical in configuration, operation, and functionality as described hereinabove.

In FIG. 4, leading edge slot configuration 14 and float locker subassembly 12 are each floatingly supported near water surface 9. Leading edge slot piece 14 is positioned between autolock unit 20 and autolock floater unit 24 and biased toward pool edge 8, with a locking pin 26 extending from the autolock unit. Vertical guide piece 28 has a number of substantially equally spaced protruding ribs 29 (the rib spacing large enough to allow leading edge slot piece to enter) as shown in the figure. When fully advanced towards the pool edge, the leading edge slot piece is positioned into the rib spacing between two successive protruding ribs 29 (not visible in the figure).

The configuration of leading edge slot piece 14 shown in FIG. 4, with locking pin 26 extended, is that of float locker subassembly 12 and the pool cover in a "locked" or "secured" status, as described further hereinbelow.

In FIG. 5, showing "detail A" (with water surface 9 not included in the figures), view (a) shows locking pin 26 extended into rectangular slot 16—i.e. locked status; whereas view (b) shows locking pin 26 retracted—i.e. unlocked or open status. When leading edge slot piece 14 is in a locked status, movement towards or away from the pool edge ("x direction") is constrained within an x-range of motion, described further hereinbelow, by the locking pin extended into rectangular slot 16. Similarly, movement to the left or right of vertical guide piece 28 and parallel to the pool edge ("y direction") is constrained within a y-range of motion, described further hereinbelow, by the locking pin extended into rectangular slot 16. Finally, in the locked status, movement above or below the water surface ("z direction" or "vertical direction") is constrained by leading edge slot piece 14 within a z-range of motion, described further hereinbelow, by the space between successive protruding ribs of vertical guide piece 28. In summary, when in a locked status, leading edge piece 14 (as well as pool cover 6 of FIGS. 1 and 2) is constrained in motion within respective, x, y, and z ranges of motion.

Typically, rectangular slot 16 measures approximately from 5 to 15 cm by 0.5 to 2 cm, so that the x-range of motion is approximately 11 cm and the y-range of motion is approximately 2 cm, depending, inter alia, on the slot size. The z-range of motion is variable and dependent on the pool level but is generally less than approximately 50 cm. Spacing of respective float locker assemblies in the y-direction typically ranges from 1-1.5 meters.

Locking pin 26 is biased by a spring within the autolock unit (not shown in the figure) so that the locking pin is normally maintained in an extended position (i.e. locked position). The spring configuration of the locking pin is similar to that of a tongue in a typical lock, as known in the art, so that when leading edge slot piece 14 is urged against the locking pin (when the pool cover is commanded to move to a closed position) locking pin 26 initially opens. However locking pin 26 is urged back into an extended position by the spring as the leading edge slot piece further advances and the slot is presented to the locking pin.

Figure 6:
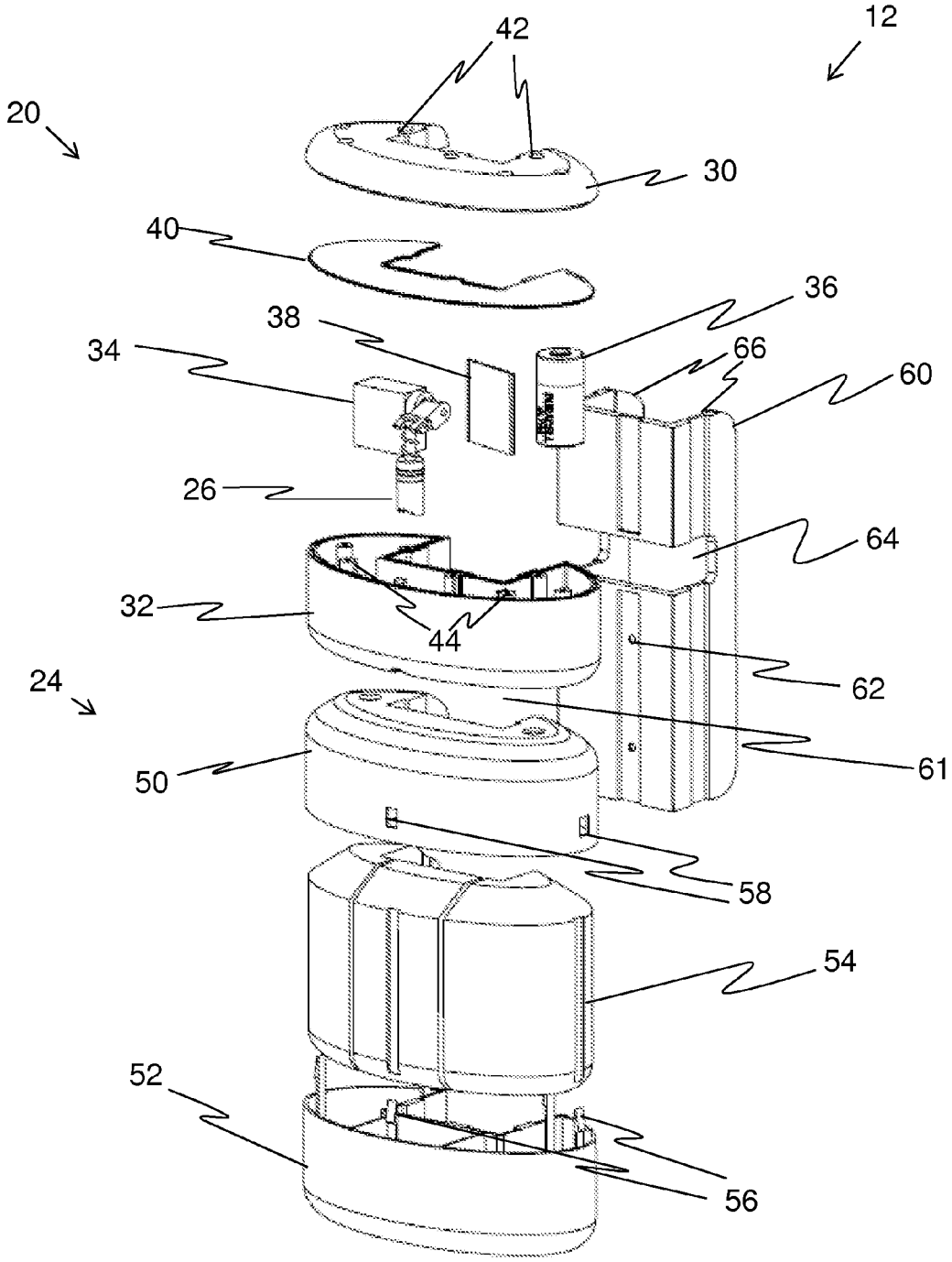
FIG. 6 is an isometric exploded view of the float locker subassembly shown in FIGS. 3 and 4.

Reference is currently made to FIG. 6, which is an isometric exploded view of float locker subassembly 12, shown in FIGS. 3 and 4. Apart from differences described below, float locker subassembly 12 is identical in notation, configuration, and functionality to that shown in previous figures, and elements indicated by the same reference numerals and/or letters are generally identical in configuration, operation, and functionality as described hereinabove.

Autolock unit 20 comprises an upper autolock unit cover 30 and an autolock unit housing 32. Housed within the autolock unit housing are: pin drive motor 34 (which controls locking pin 26 movement in and out of the autolock unit); power source 36; and autolock unit electronics 38—all of which are sealed in a waterproof configuration by seal 40. Part of autolock unit electronics is a limit switch (not shown in the figures) which provides an indication of the configuration of the locking pin (extended or retracted) and thereby an indication of "locked" and "open" (or "unlocked") status, respectively. Autolock unit electronics 38 control pin drive motor 34 (to retract the locking pin to an "open" or "unlocked" status) as well as providing telemetry and receiving commands from an autolock control unit (not shown in the figure and described further hereinbelow). In one embodiment of the current invention power source 36 is a standard 3V battery having a charge capacity to allow successive daily lock/unlock movement by the drive motor for at least one year.

Unit cover 30 is secured in place over seal 40 and onto unit housing 32 by means of screws inserted into holes 42 in cover 30, and the screws mate with blind screw sockets 44, formed into unit housing 32—thereby contributing to a watertight configuration for the mechanical and electronic parts described hereinabove.

Autolock floater unit 24 includes an upper autolock floater unit cover 50 and an autolock unit base 52. Flotation element 54 is positioned within/between unit cover 50 and base 52. Barbed legs 56, extending from base 52, are configured to mate with receiving slots 58, the receiving slots located in cover 50. Floatation element 54 is constrained into position when cover 50 and base 52 are closed upon the flotation element and the barbed legs click into place into respective receiving slots, as known in the art. Because of the buoyancy of floatation element 54, autolock floater unit 24 provides buoyancy to autolock unit 20, due to a mechanical connection between the autolock floater unit and the autolock unit, as described further hereinbelow.

Autolock unit cover 30, autolock unit housing 32, autolock floater unit cover 50 and autolock floater unit base 52 are all formed of lightweight, corrosion-free, waterproof materials, such as but not limited to composite and UV protected plastic materials.

Float locker subassembly 12 further includes a retention bracket 60, having a cross-sectional profile shape similar to a flattened letter "U" (with serifs), as seen in FIG. 6. Retention bracket 60 is attached to autolock floater unit 24 by screws in holes 62 and the bracket is additionally mechanically attached to autolock unit 20, preferably by sliding the autolock unit onto retention bracket 60, as shown in the figure. Because it is desirable to maintain autolock unit 20 in a sealed, watertight configuration (i.e. without any fastener penetrations) and because the autolock unit is supported floatingly from beneath on the bracket, in one embodiment of the current invention it is sufficient to have the autolock unit slidingly connected retention bracket 60. A space 61 is defined by the distance between autolock unit 20 and autolock floater unit 24, which is maintained by retention bracket 60. Space 61 is approximately 2 cm—but may have a dimension ranging approximately 2-10 mm larger than the thickness of the leading edge slot piece. Slot 64, formed in the retention bracket and which receives the leading edge slot piece, has a similar dimension as space 61. Inward facing flanges 66, formed in the upper portion of retention bracket 60, allow retention bracket 60 to mate slidingly with guided vertical piece 28 (as shown in FIGS. 3, 4, and 5) as described hereinbelow. Float locker assembly 10 is designed to withstand a pulling force of 250 kg in either x or y directions.

Retention bracket 60, with autolock unit 20 and autolock floater unit 24 connected, is slidingly guided over vertical guide piece 28, thereby constraining motion of float locker subassembly 12 in the x direction (toward and way from the pool edge, ref FIGS. 3 and 4) and in the y direction (left and right of vertical guide piece 28) but allowing relatively free motion in the z direction (up and down relative to the water surface—ref FIGS. 3 and 4). In this way, float locker subassembly 12 moves floatingly with the water surface, and is aligned in the z direction to receive leading edge piece 14, as shown in FIGS. 3, 4, and 5 hereinabove. Furthermore, slot 64 in the retention bracket allows bbb14 to advance fully and to be constrained with ribs 29 (ref FIGS. 4 and 5).

Figure 7:
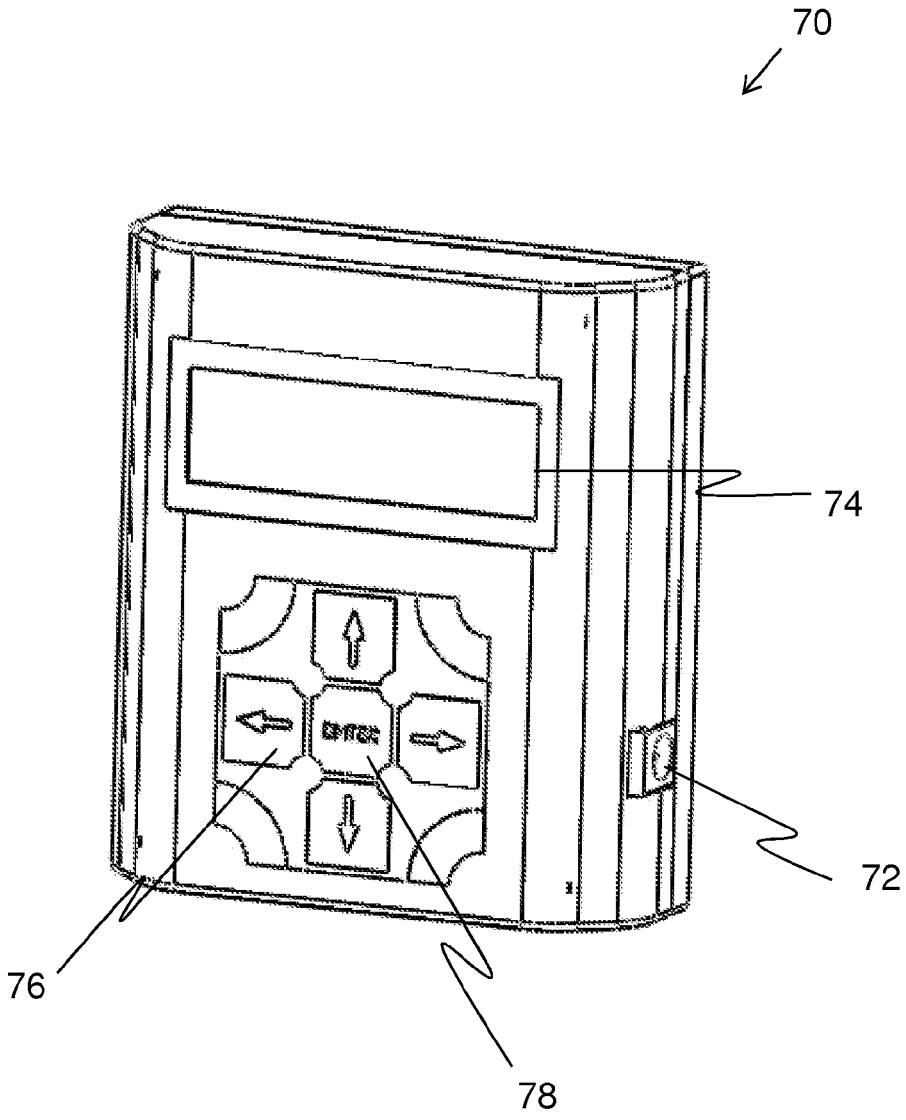
FIG. 7 is a pictorial representation of an autolock control unit, in accordance with an embodiment of the current invention.
Figure 8:
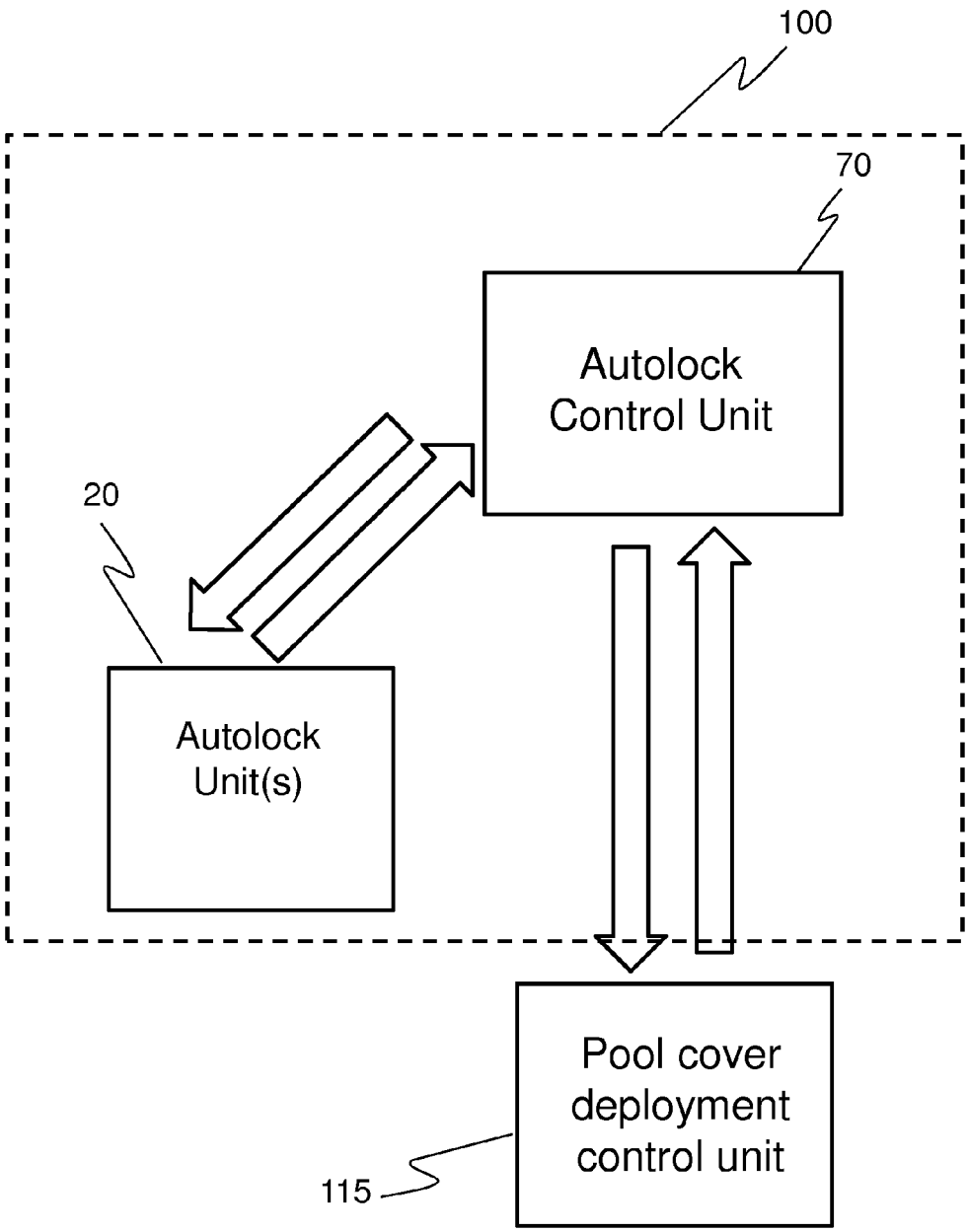
FIG. 8 is a block diagram of an autolock control system, both figures in accordance with embodiments of the current invention.

Reference is currently made to FIG. 7, which is a pictorial representation of an autolock control unit 70, and to FIG. 8, which is a block diagram of an autolock control system 100, both figures in accordance with embodiments of the current invention. In one embodiment of the current invention, autolock control unit 70 comprises a device as shown in the figure and described hereinbelow. In other embodiments of the current invention autolock control unit optionally or alternatively comprises a unit more resembling an electrical panel and suitable to be mounted nearby to and/or adjacent with other electrical/electronic units, such as but not limited to a pool cover deployment control unit 115, which typically controls a motorized pool cover deployment system (not shown in the figures). Apart from differences described below autolock unit 20 is identical in notation, configuration, and functionality to that shown in previous figures, and elements indicated by the same reference numerals and/or letters are generally identical in configuration, operation, and functionality as described hereinabove.

Autolock control unit 70 includes a power on/off button 72; a display 74; one or more function buttons 76; and a selecting button 78. Autolock control unit. Autolock control unit 70 has internal electronics and a power source (not shown in the figure) allowing it to operate, give commands, and receive telemetry from one or more autolock units 20 (ref FIGS. 3-6). Typically, autolock control unit 70 is used by an operator to control and monitor locking and unlocking functionality of the autolock units and to communicate and coordinate operation of the autolock units with deployment and stowing of the pool cover by pool cover deployment control unit 115. Communications of the autolock control unit with autolock units and pool cover deployment control unit 115 (indicated by the heavy arrows in FIG. 8) is typically by wireless means, as known in the art, and is effective for typical ranges in a pool environment, such as but not limited to a rage of approximately 30 m.

Figure 9:
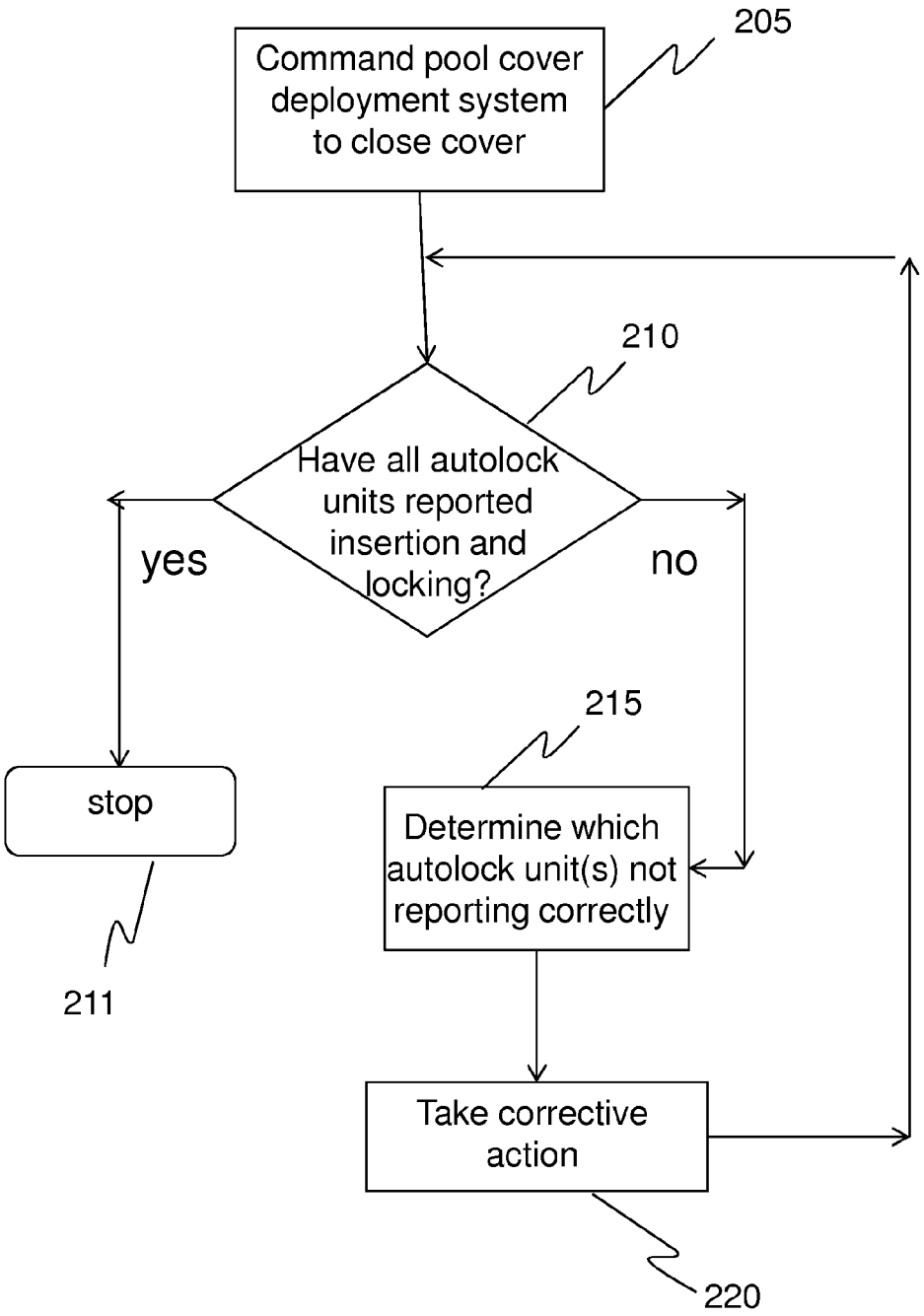
FIGS. 9 and 10 are flowcharts describing the steps of unlocking a locked pool cover and locking a deployed pool cover, respectively, in accordance with embodiments of the current invention.
Figure 10:
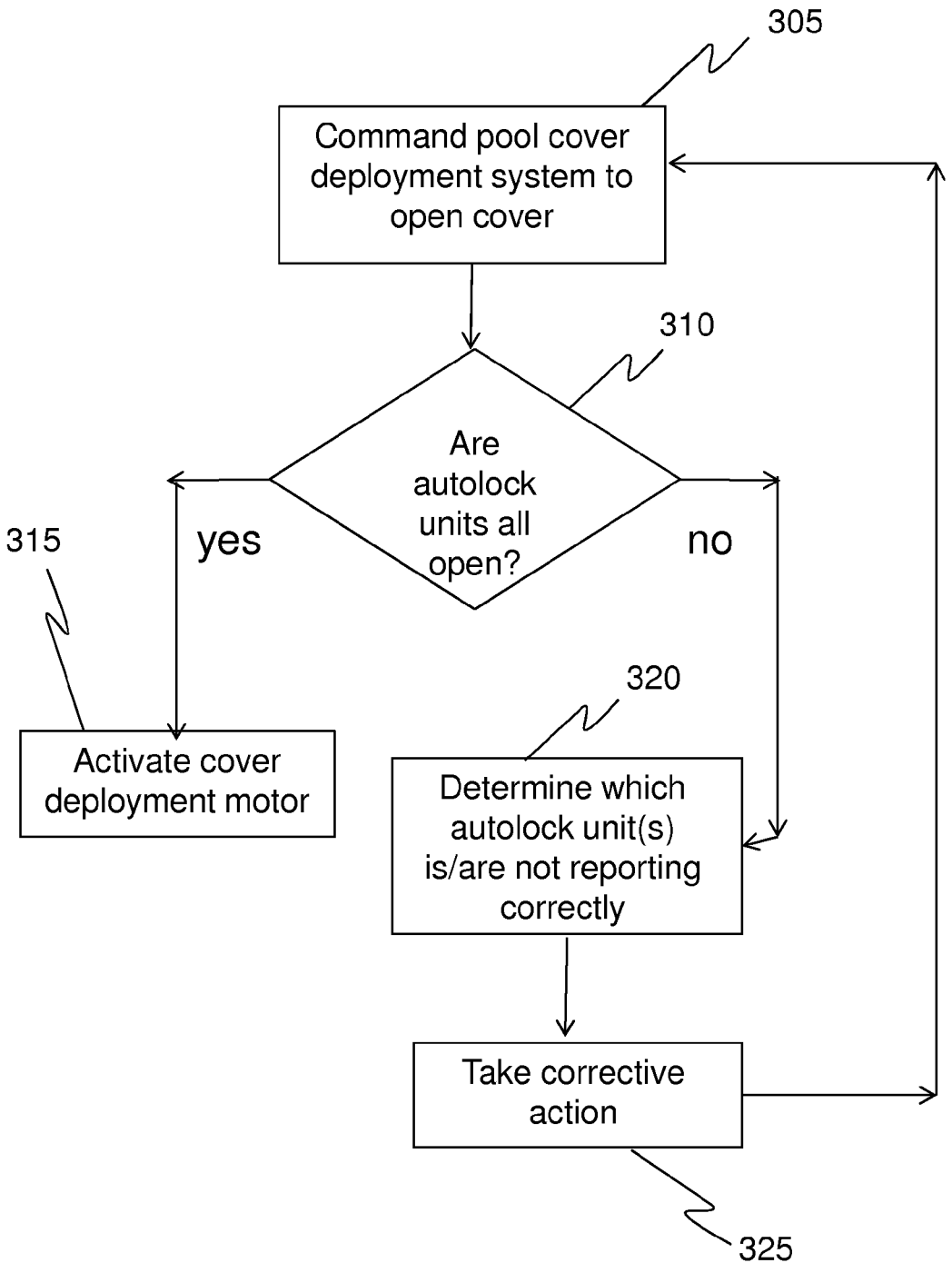

Reference is currently made to FIGS. 9 and 10, which are flowcharts describing the steps of locking a deployed pool cover and unlocking a locked pool cover, respectively, in accordance with embodiments of the current invention. Apart from any differences described below, the autolock unit, the autolock control system, and the pool cover deployment system are identical in notation, configuration, and functionality to that shown in FIG. 8.

In FIG. 9, in step 305, the pool cover deployment system is commanded into motion, typically from its stowed end, to traverse the pool to the pool edge where the autolock unit(s) is(are) located. The leading edge of the pool cover is driven to be inserted into the autolock unit(s) and automatic locking, as described previously hereinabove. Then, the autolock unit(s) sends telemetry to the autolock control system confirming automatic locking. In parallel, the autolock control system commands the pool cover deployment system to stop advancing the cover (not indicated in the figure). In step 210, a check is performed to ensure all autolock units have reported automatic locking. If the result is "yes", control proceeds to step 211, stop—and all autolock units are correctly locked. If the result is "no", control is transferred to step 215, determine which autolock unit(s) not reporting correctly (i.e. being unlocked, instead of locked). Determining which autolock unit may be done, for example, by knowing which autolock unit(s) sent telemetry indicating no locking. Alternatively or optionally, a physical inspection can be made to make the determination. In step 220, take corrective action, one option would be to command all autolock units to open and then command all autolock units to relock and to then recheck. Optionally or alternatively, the autolock unit(s) which is(are) not locked may be manually inspected and manually locked.

In FIG. 10, starting from a condition where the pool cover is locked in position by all autolock units, in step 305 a command is given to the pool cover deployment system to open the cover—meaning to unlock the autolock units and retract the deployed cover so that it may be stowed at the end of the pool opposite where the autolock unit(s) is(are) located. Along with the command to open the cover, a command is generated to open all the autolock units and the autolock units typically send telemetry confirming open status. In step 310, before the pool cover is set into motion, a check is made to determine if all autolock units indicate an open status. If the result is "yes" in step 315, the pool cover deployment system is allowed to activate the deployment motor and the pool cover moves away from the autolock unit(s) so the that the cover may be stowed.

If the result is "no", control is transferred to step 320, determine which autolock unit(s) not reporting correctly (i.e. locked, instead of unlocked). Determining which autolock unit may be done, for example, by knowing which autolock unit(s) sent telemetry indicating no unlocking. In step 325, take corrective action, one option would be to command all autolock units to lock and then command all autolock units to unlock and then recheck. Optionally or alternatively, the autolock unit(s) which is(are) not unlocked may be manually inspected and manually unlocked.

Major advantages and features of embodiments of the current invention, as described hereinabove, include:

- Fully automatic operation following the command to deploy the cover, or alternatively, to unlock and stow the cover. One way of commanding the system is by wireless communication.
- Manual override of the system—such as manually locking or unlocking one or more autolock units—in case of a failure.
- The system is suitable for above ground or in ground pools and/or covers that deployed under water or from a "dry pit" because the autolock system is mounted only at the pool edge.

It will be appreciated that the above descriptions are intended only to serve as examples, and that many other embodiments are possible within the scope of the present invention as defined in the appended claims.

The invention claimed is:

1. An automatic system for locking and unlocking a pool cover having a leading edge, the pool having a water surface and a pool edge, the pool edge is defined by a sidewall of the pool and by an exterior surface; the pool cover deployable by a pool cover deployment system, the automatic system comprising:

- a leading edge slot piece integratable into the leading edge of the pool cover;
- an edge mounting bracket that has a first portion that contacts the sidewall of the pool and a second portion that is oriented to the first portion and contacts the exterior surface when the edge mounting bracket is constrained to the edge of the pool;
- a float locker subassembly movable floatingly with the water surface and coupled led to the edge mounting bracket, the float locker subassembly having a space defined therein in which the leading edge slot piece is adapted to be received, locked, and unlocked; and
- an autolock control unit adapted to communicate with the float locker subassembly and the pool cover deployment system,
- wherein the autolock control unit is further adapted to command and verify locking and unlocking of the leading edge slot piece with the float locker subassembly.

2. The system of claim 1, wherein the leading edge of the pool cover is displaceable floatingly on the water surface.

3. The system of claim 2, wherein the float locker subassembly further comprises:

- an autolock unit, maintainable above the water surface and having a locking pin adapted to lock and unlock the leading edge slot piece with the float locker subassembly; and
- an autolock floater unit mechanically attached beneath the autolock unit and separated by the space, the autolock floater unit adapted to be floatingly maintained with regard to the water surface and to present the space to the leading edge slot piece.

4. The system of claim 3 wherein the autolock unit comprises:

- a pin driver motor adapted to retract the locking pin to an unlocked status;
- a sensor adapted to sense a locked and unlocked status of the locking pin;
- command and telemetry electronics adapted to receive commands from the autolock control unit to command the pin drive motor and to provide telemetry to the autolock control unit related to the locking pin status; and
- a power source adapted to provide on board power for the pin drive motor, the sensor, and the command and telemetry electronics.

5. The system of claim 4, wherein the locking pin is adapted to be biased by a spring to have a locked status when the leading edge slot piece is inserted into the space and the rectangular slot is positionable in the space beneath the locking pin.

6. The system of claim 5, wherein the float locker subassembly is slidingly attachable to a vertical guide piece, the vertical guide piece being oriented substantially perpendicularly to the water surface and extending partially below and above the water surface.

7. The system of claim 6, wherein the vertical guide piece is adapted to be mechanically attached to the edge mounting bracket.

8. The system of claim 7, wherein the vertical guide piece has a plurality of protruding ribs, the plurality of protruding ribs oriented substantially perpendicular to the water surface and having a rib spacing dimension substantially equal to that of the space beneath the locking pin and wherein the float locker subassembly is formable to move slidingly with regard to the protruding ribs.

9. The system of claim 1, wherein the at least one leading edge slot piece is substantially constrained in directions parallel and perpendicular to the water surface when the leading edge slot piece is locked in the float locker subassembly.

10. A method of using an automatic system for locking and unlocking a pool cover having a leading edge, the pool having a water surface and a pool edge, the pool edge is defined by a sidewall of the pool and by an exterior surface, the pool cover deployable by a pool cover deployment system, the method comprising the steps of:

configuring at least one leading edge slot piece having a slot therein and integrating the leading edge slot piece into the leading edge;

constraining to the edge of the pool an edge mounting bracket that has a first portion that contacts the sidewall of the pool and a second portion that is oriented to the first portion and contacts the exterior surface; wherein the edge mounting bracket is coupled to a float locker subassembly that is movable floatingly with the water surface and has a space defined therein in which the leading edge slot piece is received, locked, and unlocked; and taking an autolock control unit to communicate with the float locker subassembly and the pool cover deployment system, whereby the control unit further commands and verifies locking and unlocking of the at least one leading edge slot piece with the float locker subassembly.

11. The method of claim 10, whereby the leading edge of the pool cover is displaced floatingly on the water surface.

12. The method of claim 11, whereby locking a deployed pool cover further comprises the steps of:

commanding the pool cover deployment system to advance the leading edge of the pool cover towards the sidewall of the pool substantially at the water surface;

configuring an autolock unit of the float locker subassembly to receive the leading edge and to lock and sense the locking of the leading edge;

configuring an autolock control unit receive telemetry from each of the autolock unit indicative of the locking of the leading edge and communicating with the pool cover deployment system to command the pool cover deployment system to stop advancing the leading edge; and determining that each of the autolock unit has locked the leading edge and taking corrective action if the autoock unit has not locked the leading edge.

13. The method of claim 11, whereby unlocking a locked pool cover further comprises the steps of:

commanding the pool cover deployment system to unlock the locked pool cover and commanding an autolock unit of the float locker subassembly to unlock the leading edge and to sense the unlocking of the leading edge;

configuring an autolock control system to receive telemetry from each of the autolock unit related to the unlocking of the leading edge;

determining that each of the autolock unit has unlocked the leading edge and taking corrective action if the autoock unit has not unlocked the leading edge; and communicating with the pool cover deployment system and commanding the pool cover deployment system to start retracting the leading edge once a positive determination is made that each of the autolock unit has unlocked the leading edge.

14. The system of claim 1 wherein the second portion is normal to the first portion.

* * * * *